US006707252B2

(12) United States Patent
Kakisaka et al.

(10) Patent No.: US 6,707,252 B2
(45) Date of Patent: Mar. 16, 2004

(54) METAL HALIDE LAMP

(75) Inventors: Shunsuke Kakisaka, Ibaraki (JP); Shigefumi Oda, Takatsuki (JP); Yoshiharu Nishiura, Otsu (JP); Masanori Higashi, Takatsuki (JP); Hiroshi Enami, Nishinomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/185,950

(22) Filed: Jun. 27, 2002

(65) Prior Publication Data

US 2003/0025453 A1 Feb. 6, 2003

(30) Foreign Application Priority Data

Jun. 29, 2001 (JP) ..... 2001-199149
Mar. 14, 2002 (JP) ..... 2002-070742

(51) Int. Cl.[7] ..... H01J 17/18; H01J 61/04
(52) U.S. Cl. ..... 313/623; 313/621
(58) Field of Search ..... 313/620, 621, 313/623, 634, 637, 638, 639, 606

(56) References Cited

U.S. PATENT DOCUMENTS

| | | | | |
|---|---|---|---|---|
| 3,798,487 A | | 3/1974 | Zollweg et al. | 313/229 |
| 4,422,011 A | | 12/1983 | Bruninx-Poesen et al. | 313/642 |
| 4,634,927 A | | 1/1987 | Mori et al. | 313/486 |
| 5,239,232 A | | 8/1993 | Heider et al. | 313/639 |
| 5,936,351 A | | 8/1999 | Lang | 313/623 |
| 5,973,453 A | | 10/1999 | Van Vliet et al. | 313/623 |
| 5,973,454 A | * | 10/1999 | Ooyama et al. | 313/639 |
| 6,069,456 A | | 5/2000 | Fromm et al. | 315/248 |
| 6,501,220 B1 | * | 12/2002 | Lambrechts et al. | 313/571 |

FOREIGN PATENT DOCUMENTS

| | | |
|---|---|---|
| EP | 0 049 545 | 4/1982 |
| EP | 0 453 893 | 10/1991 |
| EP | 0 905 744 | 3/1999 |
| EP | 1 271 614 | 1/2003 |
| JP | 54-102070 | 8/1979 |
| JP | 57-92747 | 6/1982 |
| JP | 8-36994 | 2/1996 |
| JP | 10-144261 | 5/1998 |
| JP | 2000-501563 | 2/2000 |
| WO | WO 98/25294 | 6/1998 |

* cited by examiner

*Primary Examiner*—James Clinger
*Assistant Examiner*—Minh D. A
(74) *Attorney, Agent, or Firm*—Merchant & Gould P.C.

(57) ABSTRACT

A safety metal halide lamp with a high luminous efficiency and a long lamp life is provided. The metal halide lamp includes an arc tube made of light-transmissive ceramic, in which a pair of electrodes is provided and cerium iodide ($CeI_3$) and sodium iodide (NaI) are enclosed as a light-emitting substance, wherein a molar composition rate NaI/$CeI_3$ of the light-emitting substance is specified within a range of 3.8 to 10, inclusive, and a wall load on the arc tube ranges from 13 to 23 W/cm$^2$, inclusive, and on a series of X, Y coordinates, where X denotes a value of a lamp watt (W) and Y denotes a value of Le/ϕi, where Le and ϕi denote a distance between the pair of electrodes and an internal diameter of the arc tube, respectively, values of the Le/ϕi and the lamp watt are specified to be within a range surrounded by lines passing through the points (200, 0.75), (300,0.80), (400, 0.85), (700, 1.00), (1,000, 1.15), (1,000, 2.10), (700, 2.00), (400, 1.90), (300, 1.80), and (200, 1.70) in this stated order.

7 Claims, 9 Drawing Sheets

METAL HALIDE LAMP

BACKGROUND OF THE INVENTION

1. Field of the Invention

The present invention relates to a metal halide lamp.

2. Related Background Art

Recently, metal halide lamps having an arc tube made of semitransparent polycrystalline alumina ceramic have been developed actively as substitutes for lamps having a quartz tube. Since this alumina ceramic tube has the heat-resistant temperature of 1,200° C., which is higher than the heat-resistant temperature (1,000° C.) of the quartz tube that has been used conventionally, a load imposed on the wall of the arc tube (hereafter called wall load) can be set higher, so that a metal halide lamp with a higher lamp efficiency can be obtained. With regard to this kind of lamp, low watt type lamps with a lamp input of 70 to 150W used for general interior lighting have been developed and commercialized mainly. However, high watt type lamps with a lamp input of 200 to 1,000W used for general exterior lighting also are being demanded now by the market.

An available low watt type metal halide lamp for interior lighting (e.g. for shops) having an alumina ceramic tube, for example in a case of a 150W type, has excellent properties of the lamp efficiency of 90 lm/W, the average color rendering index Ra of 90 and the rated life of 6,000 h. It should be noted that "the rated life" refers to an aging elapsed time when the luminous flux of the lamp is lowered to 70% of the value at the aging time of 100 h.

FIG. 8 is a cross-sectional view showing the construction of the arc tube in such a lamp. The arc tube 115 includes a light-emitting portion 116 made of polycrystalline alumina ceramic, which functions as a discharge arc region, and narrow tubes 117 and 118 provided at the both ends of the light-emitting portion 116. The light-emitting portion 116 and the narrow tubes 117 and 118 are integrated with each other by shrinkage fit. Inside of the light-emitting portion 116, a pair of tungsten electrodes 119 and 120 is provided. Into the narrow tubes 117 and 118, electrical supply members 121 and 122 made of niobium or an electrically conductive cermet are sealed hermetically with frit. At the discharge side ends of the electrical supply members 121 and 122, electrode rods extending from the tungsten electrodes 119 and 120 are connected. Within the arc tube 115, a light-emitting substance including metal halides such as $DyI_3$, $TmI_3$, $HoI_3$, TlI, and NaI, Hg functioning as a buffer gas and a rare gas for supporting ignition such as Ar are each filled.

Basically, the shape of the arc tube in the above-stated low watt type metal halide lamp employing the alumina ceramic tube is the same as that of the conventional metal halide lamp having a quartz arc tube used for interior lighting. That is, the typical dimensions of the alumina ceramic arc tube with the configuration shown in FIG. 8, in a case of 150W type, for example, are the distance between electrodes Le of 10 mm and the inner diameter of tube ϕi of 10.6 mm. In this case, a so-called arc tube shape parameter Le/ϕi, which is a major parameter indicating the shape of the arc tube, becomes 0.94. The wall load "we"0 on the arc tube during operation of the lamp is 27 W/cm$^2$. Note here that, assuming that the lamp watt and the internal surface area of the arc tube are $W_{1a}$ and $S_a$, respectively, then the wall load "we" can be represented by $we=W_{1a}/S_a$.

On the other hand, as for the conventional lamp with a quartz arc tube, dimensions of the typical 150W type lamp are the distance between electrodes Le of 13.5 mm and the internal diameter of the tube ϕi of 13 mm, so that the value of Le/ϕi becomes 1.04. That is, the values of arc tube shape parameter Le/ϕi are set at almost the same level for both lamps. Therefore, it can be said that both of the arc tube in the conventional low watt type alumina ceramic lamp for interior lighting and the quartz arc tube metal halide lamp have a relatively thick and short shape.

As another example, JP10(1998)-144261 A discloses a so-called short arc type metal halide lamp of a 20 to 250 W type, employing an alumina ceramic tube. The feature of this lamp resides in that, as illustrated in FIG. 9, a discharge light-emitting portion in an arc tube 123 includes a cylindrical-shaped center portion 124 and hemispherical end portions 125 and 126. The value of arc tube shape parameter Le/ϕi of this lamp is specified within a range between 0.66 and 1.25, which corresponds to the low-watt type lamp for interior lighting shown in FIG. 8, whereas the wall load "we" is specified within a relatively high range of 25 to 35 W/cm$^2$. In this way, this lamp can be grouped into a short arc type high-pressure discharge lamp for specialized lighting purpose, and the arc tube has a thick and short shape, which is the same as the above-stated low-watt type metal halide lamp for interior lighting. As for a light-emitting substance of this lamp, metal halides such as $DyI_3$, $TmI_3$, $HoI_3$, TlI, and NaI as described above are filled therein.

Meanwhile, U.S. Pat. No. 5,973,453 discloses the shape of an arc tube in a high efficiency metal halide lamp for general exterior lighting, employing an alumina ceramic tube. In this lamp, a cerium halide based substance, whose emission spectrum lies in a wavelength region with a high spectral luminous efficiency, is filled as a light-emitting substance especially for realizing a lamp with a high luminous efficiency. As a specific light-emitting substance, cerium iodide ($CeI_3$) and sodium iodide (NaI) are filled in a molar ratio of $NaI/CeI_3$ ranging 3 from 25. Thereby, excellent properties of a high lamp efficiency of 130 lm/w and an average color rendering index Ra of 58 are realized in a 150 W type lamp. In this case, the value of arc tube shape parameter Le/ϕi is specified within a range greater than 5 in order to attain a high luminous efficiency and a long life required for general exterior lighting sources. As described later, such an arc tube has a thin and long shape, which is common to the conventional high-pressure sodium lamp and metal halide lamp for general exterior lighting. The wall load of the lamp is specified to be 30 W/cm$^2$ or less.

Note here that the alumina ceramic tube was originally invented, developed, and adapted for a material of arc tubes for high-pressure sodium lamps for general exterior lighting. In this case also, the above-mentioned feature of the alumina-ceramic tube is exploited, so that, for instance in a 400 W type, a high luminous efficiency and long life high-pressure sodium lamp with a lamp efficiency of approximately 140 lm/W and a rated life of 2,000 h, and also with a relatively low average color rendering index Ra of 25, was developed and became widely available. Here, the arc tube of the high-pressure sodium lamp has a thin and long shape and the value of arc tube shape parameter Le/ϕi is increased with the increase in the lamp input. For example, the specific dimensions of the lamp of a 400 W type are the distance between electrodes Le of 84 mm and the inner diameter of arc tube ϕi of 7.65 mm, so that the value of Le/ϕi is set at 11.0. Whereas, those of the lamp of a 700 W type are 134 mm in Le and 9.7 mm in ϕI, so that the value of Le/ϕi is set at 13.0. The wall loads of the arc tube are set at approximately 15 W/cm$^2$ in the 400 W type and 13 W/cm$^2$ in the 700 W type.

In addition, also in the conventional quartz arc tube type metal halide lamp of a high watt type for exterior lighting, a relatively thin and long shaped arc tube is employed basically, as compared with the above-described thick and short shaped arc tube of a low watt type for interior lighting. In this case also, the value of arc tube shape parameter Le/ϕi is increased with the increase in the lamp input. For example, the typical values of Le/ϕi are set at 2.1, 2.2, 2.5, and 2.7 in a type of 300 W, 400 W, 700 W, and 1,000 W, respectively. In general, the rated life of the lamp is specified at 9,000 h or more.

As described above, the high-pressure discharge lamp can be classified into two types in terms of the shape of the arc tube. One is a so-called long arc lamp of a high watt type having a thin and long shape used for general exterior lighting. The other includes a low-watt type lamp for interior lighting such as for shops and a lamp for specific lighting purposes such as for projection, exposure and studio lighting. The latter lamps are so-called short-arc type lamps having a relatively thick and short shaped arc tube.

As for the former lamps, that is, conventional high-watt type high-pressure sodium lamps and metal halide lamps for general exterior lighting, the reason for employing a thin and long shaped arc tube is that these lamps need to have a long life property of 9,000 h or more in general, in addition to a high luminous efficiency as their lamp properties. That is to say, the life of the high-pressure discharge lamp mainly depends on the blackening of the arc tube, which is generated due to vaporization and scattering of the material constituting the electrodes at both ends of the arc tube. However, even when the lamp input is increased, a thinner and longer lamp shape allows prevention of the center portion of the arc tube from being influenced by the blackening due to the electrode constituting material, so that a lamp with a long life can be obtained. In addition, even when an alumina ceramic tube with superior durability and heat-resistance is employed, the value of the wall load "we" of the arc tube in the lamp for general exterior lighting is specified within a range of 23 W/cm$^2$ or less in general. This range is equivalent for the wall temperature of approximately 1,150° C. or less and is one of the conditions necessary to attain the above-mentioned long life of 9,000 h or more.

In order to respond to demands from the market, the inventors of the present invention have worked toward development of a 200 W or more of high-watt type metal halide lamp employing an alumina ceramic tube for general exterior lighting. Firstly, the inventors selected cerium iodide and sodium iodide as a light-emitting substance for obtaining a high lamp efficiency, which allows, for example, substitution of the conventional quartz arc tube metal halide lamp of a 400 W type, which is the leading mainstream of the lamps, with a lamp of a 300 W type.

However, when cerium iodide and sodium iodide are used as a light-emitting substance in a metal halide lamp with a thin and long shaped alumina ceramic tube, then problems specific to such a lamp of "a crack in an alumina ceramic arc tube" and "disappearance of the discharge arc" occur, which are not generated in the conventional quartz arc tube metal halide lamp, and high pressure sodium lamp and low-watt type metal halide lamp that employ an alumina ceramic arc tube.

The above-described "crack in an alumina ceramic arc tube" often occurs at a central portion of the tube when the arc tube is lit up in a horizontal position. Especially, an incidence of the crack is relatively higher during the initial aging time period of 60 minutes immediately after manufacturing the lamp. The crack is generated often along most of the tube diameter to extend across the whole tube, or a crack might be generated partially in an upper portion of the arc tube lit up in a horizontal position. Meanwhile, an incidence of the "disappearance of the discharge arc" is higher within 30 to 300 seconds just after the starting of the initial aging time period immediately after manufacturing the lamp. It can be estimated that these two phenomena of "a crack in an arc tube" and "disappearance of the discharge arc" depend on the cerium and sodium iodide ($CeI_3$+NaI) based light-emitting substance itself, which is filled in the arc tube. These phenomena hardly occur in the lamp into which only NaI is filled, for example. In this way, it can be said that these phenomena are specific to the cerium and sodium iodide ($CeI_3$+NaI) based light-emitting substance.

In addition, in order to respond to demands for a lamp with a higher luminous efficiency, a high efficiency metal such as cerium and praseodymium may be used, which results in a substantial increase in the load on the arc tube because of low vapor pressures of these metals. As a result, if the airtightness of the shrinkage fitting portion is not excellent, then the portion could not resist the vapor pressure during lighting, so that the lamp would burst.

In order to enhance the reliability of the shrinkage fitting portion, the thickness of the wall of that portion needs to be increased. However, when increasing the thickness of the wall of the shrinkage fitting portion, a thermal loss at the portion increases, which results in a decrease in the lamp efficiency.

Furthermore, the lamp has problems that temperatures at both internal ends of the arc tube are not uniform; the luminous efficiency decreases with the decrease in the amount of the light-emitting substance enclosed in the light-emitting portion because the light-emitting substance enters into the narrow tubes; and the resistance to pressure of the arc tube decreases.

SUMMARY OF THE INVENTION

Therefore, with the foregoing in mind, it is an object of the present invention to provide a metal halide lamp with a high luminous efficiency and a long life, which is capable of securely preventing a crack in an arc tube and disappearance of the discharge arc from occurring.

It is another object of the present invention to provide a metal halide lamp with a high luminous efficiency and a long life, which has a sufficient resistance to pressure during lighting and is capable of making the temperatures at the both internal ends of the light-emitting portion uniform, decreasing thermal loss, and suppressing a decrease in the amount of the light-emitting substance that contributes to light emission.

It is still another object of the present invention to provide a metal halide lamp with a high luminous efficiency and a long life, which is capable of suppressing a fracture of the arc tube during the lifetime.

To achieve the above-stated objects, a metal halide lamp according to the present invention includes an arc tube made of light-transmissive ceramic, in which a pair of electrodes is provided and cerium iodide ($CeI_3$) and sodium iodide (NaI) are enclosed as a light-emitting substance, wherein a molar composition rate NaI/$CeI_3$ of the light-emitting substance is specified within a range of 3.8 to 10, inclusive, and a wall load on the arc tube ranges from 13 to 23 W/cm$^2$, inclusive, and on a series of X, Y coordinates, where X denotes a value of a lamp watt (W) and Y denotes a value of Le/ϕi, where Le and ϕi denote a distance between the pair of electrodes and an internal diameter of the arc tube, respectively, values of the Le/ϕi and the lamp watt are specified to be within a range surrounded by lines passing through the points (200, 0.75), (300, 0.80), (400, 0.85), (700, 1.00), (1,000, 1.15), (1,000, 2.10), (700, 2.00), (400, 1.90), (300, 1.80), and (200, 1.70) in this stated order (more specifically, the diagonally shaded area in FIG. 4).

With this configuration, the degree of the curve of a narrowed discharge arc region, which is specific to a light-emitting substance including $CeI_3$, can be mitigated and a localized increase in temperatures of the upper side of the arc tube can be lowered. Therefore, both of the problematic phenomena of a crack in the arc tube and disappearance of the discharge arc can be prevented. In addition, green spectrum radiation having a high relative luminous efficiency from $CeI_3$ is increased, whereby a high lamp efficiency can be realized. Furthermore, temperatures of the wall of the arc tube can be kept within a range for suppressing sufficiently the reaction between the light-emitting substance and the alumina ceramic tube, and the blackening of the tube end portions can be mitigated, which can realize a metal halide lamp with a long life and a high luminous efficiency.

Another metal halide lamp according to the present invention includes an arc tube made of light-transmissive ceramic, the arc tube including: a light-emitting portion in which a pair of electrodes is provided and a light-emitting substance including at least one of cerium (Ce) and praseodymium (Pr) is enclosed; narrow tubes provided at both end portions of the light-emitting portion; and an electrical supply member that is sealed within one of the narrow tube and connected to one of the pair of electrodes. The light-emitting portion is configured so that a ratio of a minimum wall thickness to a maximum wall thickness thereof becomes 0.80 or more, and the light-emitting portion and each of the narrow tubes are integrated with each other.

With this configuration, a sufficient pressure resistance property can be realized during operation of the life, and a risk of the fracture in the arc tube can be lowered. In addition, there is no joint portion between the light-emitting portion and the narrow tube such as a shrinkage fitting portion. Therefore, superior airtightness can be realized and there is no need to form a partially thick wall portion. As a result, the thermal loss becomes small, which allows the vapor pressure of the light-emitting substance to be increased sufficiently, so that the lamp efficiency can be improved.

In the above-stated metal halide lamp, it is preferable that the both end portions of the light-emitting portion have a shape whose diameter becomes smaller gradually with increasing proximity to the narrow tube. Thereby, temperatures in the arc tube can be made uniform, so that the lamp efficiency can be improved.

In the above-stated metal halide lamp, the both end portions of the light-emitting portion may have a tapered shape.

In addition, in the above-stated metal halide lamp, a cross-sectional shape of the both end portions of the light-emitting portion may be formed in a curve.

In the above-stated metal halide lamp, it is preferable that the both end portions of the light-emitting portion have an approximately hemispherical shape. With these configurations, even when the lamp is operated in a state where the arc tube is disposed vertically, the light-emitting substance does not intrude into the narrow tube, and therefore a decrease in the amount of the light-emitting substance is suppressed. Therefore, the lamp efficiency can be improved.

Further, preferably, in the aforementioned metal halide lamp, protrusions or recesses may be formed on an inner wall of the both end portions of the light-emitting portion.

DETAILED DESCRIPTION OF THE INVENTION

Embodiment 1

Figure 1:
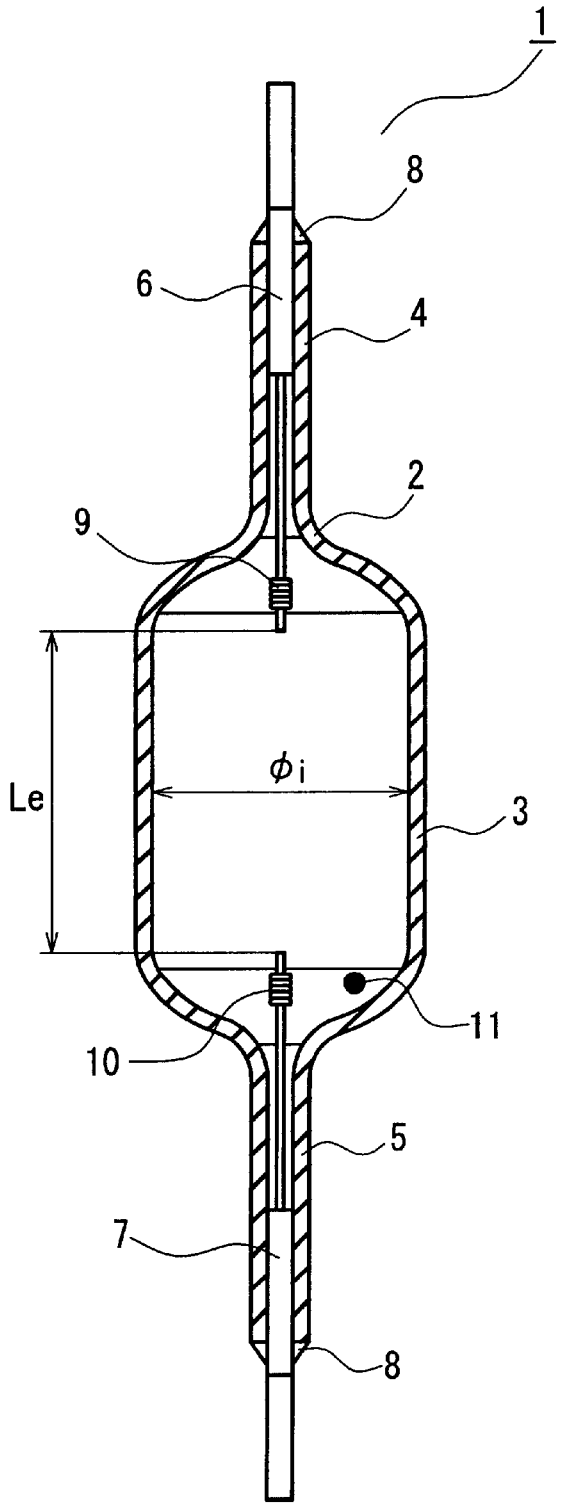
FIG. 1 is a cross-sectional view showing a construction of an arc tube in a metal halide lamp according to Embodiment 1 of the present invention.
Figure 2:
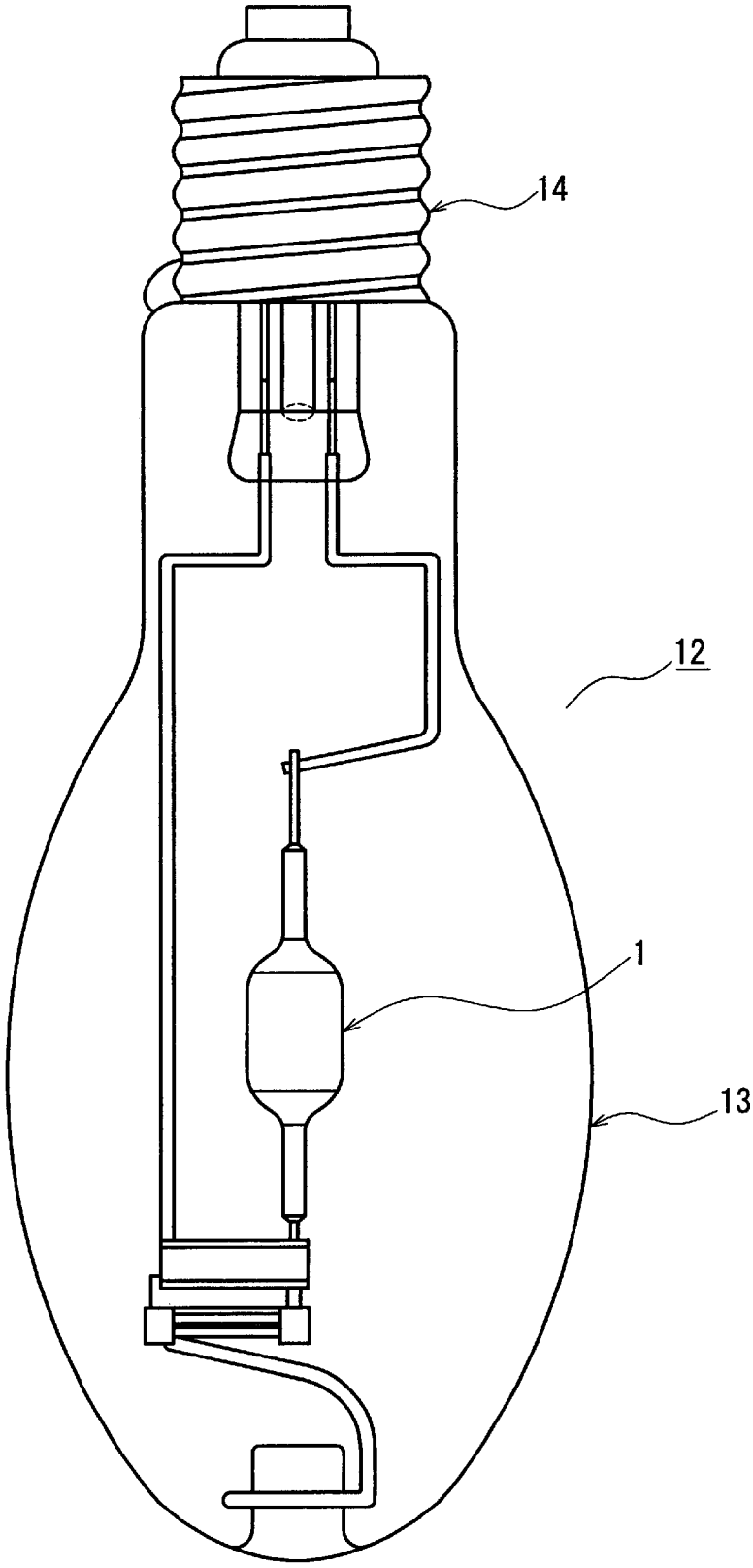
FIG. 2 shows a construction of a metal halide lamp as a whole according to the present invention.

FIGS. 1 and 2 show the construction of an arc tube of a metal halide lamp according to Embodiment 1 of the present invention and the whole construction of the lamp, respectively.

An arc tube 1 includes an enclosure 2 made of semitransparent polycrystalline alumina ceramic, having a light-emitting portion 3 whose central portion is a cylindrical shape and narrow tubes 4 and 5 provided at both ends of the light-emitting portion 3. Rod shaped electrical supply members 6 and 7 made of $Al_2O_3$—Mo based electrically conductive cermet with a resistivity of $5.1\times10^{-7}$ Ωm are sealed hermetically to the narrow tubes 4 and 5, respectively, with ceramic frit 8 including $Dy_2O_3$—$Al_2O_3$—$SiO_2$ as its main component. At the discharge side ends of the electrical supply members 6 and 7, electrode rods extending from the tungsten electrodes 9 and 10 are connected. In the case of this embodiment, in order to maintain airtightness with the narrow tubes 4 and 5 securely through the lamp life, a thermal coefficient of expansion of the electrical supply members 6 and 7 is set at $6.9\times10^{-6}$/° C., whereas that of the narrow tubes 4 and 5 made of alumina ceramic is $8.1\times10^{-6}$/° C. In order to suppress the erosion by the light-emitting substance 11 during operation of the lamp, the ceramic frit 8 is confined and filled to extend close to the joint between the narrow tube 4 or 5 and the tungsten electrode 9 or 10, which becomes a low temperature portion. A light-emitting substance 11 including cerium iodide ($CeI_3$) and sodium iodide (NaI), Hg functioning as a buffer gas and Ar of approximately 13 kPa as a rare gas for supporting ignition are each filled in the arc tube 1.

A finished lamp 12, as shown in FIG. 2, is configured so that the above-described arc tube 1 is held within an outer bulb 13 made of hard glass. In the outer bulb 13 provided with a lamp cap 14, nitrogen of 60 to 80 kPa is filled.

Firstly, the inventors of the present invention made a study of elucidating the two phenomena of "a crack in the arc tube" and "disappearance of discharge arc" in the lamp 12 of a 300 W type as a core product, which has the basic configuration shown in FIGS. 1 and 2, generated especially when the ($CeI_3$+NaI) based light-emitting substance 11 is filled therein. Further, the inventors made a study of finding means for preventing these phenomena.

More specifically, as factors having an influence upon a crack in the arc tube, two factors concerning lamp constituting elements: (i) an arc tube shape parameter Le/ϕi derived from the internal diameter ϕi of the center of the tube and the distance between electrodes Le; and (ii) the composition of the ($CeI_3$+NaI) based light-emitting substance 11, were assumed. Then, test lamps 12 having different conditions for these factors were prepared and the state of crack generation in these lamps during aging operation were investigated. In the actual embodiment, arc tubes 1 were prepared on a trial basis so that (i) the value of the arc tube shape parameter Le/ϕi was varied in a range between 0.4 and 8.0 by combining the internal diameter ϕi of the center of the tube and the distance between electrodes Le having a range of 7.6 to 20.0 mm and 8 to 60 mm, respectively, and (ii) 12 mg of the light-emitting substance 11 with a molar composition rate NaI/$CeI_3$ varying in a wide range of 2 to 50 was filled. As for the combination in the above (i) of the internal diameter ϕi and the distance between electrodes Le, such a combination was set so that the wall load "we" of the arc tube was kept in a relatively lower range of 13 to 23 W/$cm^2$ or less. This lower limit of "we" was set so as to attain a high lamp efficiency of 117 lm/W or more, which corresponds to a value up over the lamp efficiency of the conventional quartz arc tube lamp as a target by 30%. The upper limit of "we" was set so as to attain the lamp life of 9,000 h, which is required for general exterior lighting. The amount of Hg filled in the tube was adjusted in a range of 5 to 20 mg/$cm^3$ per unit volume of the arc tube so as to correspond to the average lamp voltage of 120V and the average lamp current of 2.6A during the steady-state operation of the lamp.

During aging operation of the test lamps 12 while keeping their arc tubes in a horizontal position, a state of crack generation in the arc tube and disappearance of the discharge arc was observed. In addition, the lamp properties such as the lamp efficiency during the initial aging and the lamp life property during aging were measured.

As a result of the above-mentioned tests, it was confirmed firstly that there was a definite correlation between the phenomena of a crack in the arc tube and disappearance of discharge arc and the two lamp constituting elements of the arc tube shape parameter Le/ϕi and the composition of the ($CeI_3$+NaI) based light-emitting substance.

That is to say, out of 100 lamps with the arc tube shape parameter Le/ϕi greater than 1.80 and the molar composition rate NaI/$CeI_3$ less than 3.8, 24 lamps suffered from cracks in the arc tube, and 36 lamps suffered from disappearance of discharge arc. In these lamps, 22 lamps of the 24 lamps experiencing cracks in the arc tube suffered from disappearance of discharge arc prior to the generation of the cracks. On the other hand, out of 80 lamps with the arc tube shape parameter Le/ϕi ranging from 0.40 to 1.80 and the molar composition rate NaI/$CeI_3$ ranging from 3.8 to 50, any lamps did not suffer from a crack in the arc tube and disappearance of discharge arc. It should be noted that a crack in the arc tube and the disappearance of discharge arc were both generated in the above 22 lamps, which indicates that the two phenomena are caused by the same reason. According to the investigation on the aging elapsed time when the two phenomena were generated, all of the disappearance of discharge arc in the above 36 lamps was generated within 30 to 300 seconds immediately after the initial aging operation, whereas 6 lamps out of the above 24 lamps experienced cracks in the arc tube during the initial aging of 60 minutes.

When observing the state of the discharge arc in the test lamps 12, in the lamps suffering from the two phenomena, having the Le/ϕi greater than 1.80 and the molar composition rate NaI/$CeI_3$ less than 3.8 (that is, the amount of $CeI_3$ is increased relative to that of NaI), the following were confirmed: (a) the discharge arc region from which light was emitted was narrowed uniformly; and (b) the discharge arc region was curved substantially toward the upper side of the arc tube. On the contrary, in the lamps not experiencing the two phenomena, having the Le/ϕi ranging from 0.40 to 1.80 and the molar composition rate NaI/$CeI_3$ ranging from 3.8 to 50 (that is, the amount of NaI is increased relative to that of $CeI_3$), the following were confirmed: (a) the discharge arc region extended relatively wider along the tube diameter direction; and (b) the degree of the curve of the discharge arc region toward the upper side of the arc tube was small.

Next, as a result of the measurement of the initial lamp efficiency, when the molar composition rate NaI/$CeI_3$ exceeded 10, the yellow spectrum radiation from Na was increased mainly, resulting in a failure to attain a high lamp efficiency more than 117 lm/W, which corresponds to a value over the lamp efficiency of the conventional quartz arc tube lamp by 30%. On the other hand, when the molar composition rate NaI/$CeI_3$ was within a range of 3.8 to 10, the green spectrum radiation from CeI having a high spectral luminous efficiency was increased, which could realize a lamp efficiency greater than 117 lm/W as a target.

Furthermore, as a result of the measurement of the lamp life, although the test lamps 12 whose Le/ϕi was set in a small range of 0.40 to 0.80 did not suffer from a crack in the arc tube and disappearance of discharge arc, these lamps were considerably stricken with blackening at the ends of the arc tube close to the electrodes, so that it was found that the rated lamp life of 9,000 h or more required for general exterior lighting could not be obtained.

From these results, in the arc tube of a ($CeI_3$+NaI) based metal halide lamp of a 300 W type with an alumina ceramic tube, where the lamp has a value of Le/ϕi greater than 1.80 and the amount of $CeI_3$ as a halide of a rare earth element is increased relative to that of NaI, it can be considered that generation of cracks is ascribable to a localized increase in the temperature of the wall at the upper side of the arc tube, because a discharge arc region is narrowed and is curved toward the upper side of the arc tube arranged in a horizontal position. In addition, since the disappearance of the discharge arc was generated together with the cracks in the arc tube, it can be considered that this phenomenon also is generated basically because the discharge arc region is narrowed, and therefore the discharge arc voltage increases excessively. Furthermore, it is known generally that when a light-emitting substance is present at the discharge arc region in a form of molecules, disappearance of the discharge arc likely is generated. Therefore, as for the lamp enclosing $CeI_3$ therein according to the present invention, it can be considered that the presence of the $CeI_3$ molecules, whose peculiar and wide molecular spectrum radiation was observed, promotes the disappearance of the discharge arc.

Here, it is known that when filling a rare earth element such as Ce in the lamp, the discharge arc region is narrowed because the average excitation voltage Ve in the energy level, which relates to radiation, is less than a value obtained by multiplying the ionization potential Vi by 0.585, i.e., $Ve<0.585 \cdot Vi$. When the discharge arc region is narrowed, then the temperature of the arc region increases, so that a large buoyant force acts on the discharge arc so as to curve it toward the upper side of the arc tube. Especially, in the case of a thin and long shaped arc tube whose value of Le/ϕi is greater than 1.80, the degree of the curve is promoted further. In addition, polycrystalline alumina ceramic has a greater thermal coefficient of expansion of $8.1\times10^{-6}$/° C. compared with a thermal coefficient of expansion of quartz ($5.5\times10^{-7}$/° C.) conventionally used. Accordingly, it can be said that as compared with the conventional quartz tube, the mechanical strength of the alumina ceramic tube is relatively low, especially with respect to a sudden and localized increase in temperatures due to lighting of the lamp, so that cracks are generated in such arc tubes. Also, the reason why the incidence of the cracks in the arc tube is relatively higher immediately after turning on the lamp during the initial aging operation of 60 minutes is because a chemical mixture state of the light-emitting substance inside of the arc tube and the physical distribution state thereof are in transition, which causes a sudden increase in the vapor pressure of $CeI_3$ filled therein to a higher level. Thus the discharge arc region is curved further toward the upper side of the arc tube.

On the other hand, the reason why a crack was not generated in the so-called thick and short shaped arc tubes whose value of Le/ϕi is 1.80 or less and molar composition rate $NaI/CeI_3$ is 3.8 or more can be considered as follows: That is, the discharge arc region expands wider because of the increase in the amount of NaI, which is a known fact, and moreover with the decrease in the distance between electrodes Le, the degree of the curve of the discharge arc region is reduced. In addition, with the increase in the internal diameter ϕi of the tube, the increase in temperatures on the wall of the arc tube due to the curve of the discharge arc region is mitigated.

In summary, in the 300 W type lamp employing an alumina ceramic arc tube, into which a cerium and sodium iodide ($CeI_3$+NaI) based light-emitting substance is filled, (a) a crack in the arc tube is ascribable to a low mechanical strength against the increase in temperatures of the wall resulting from the curve of the discharge arc region toward the upper side of the arc tube because of the narrowed discharge arc region, which is specific to $CeI_3$ filled therein, and a high thermal coefficient of expansion of the alumina ceramic tube, and (b) disappearance of the discharge arc is ascribable to the increase in the discharge arc voltage because of the presence of CeI molecules, in addition to the above-mentioned curve of the discharge arc region. It was found that, as a first specific means for preventing these two phenomena, it was effective highly to set the value of the arc tube shape parameter Le/ϕi and the molar composition rate $NaI/CeI_3$ at 1.80 or less and 3.8 or more, respectively. That is to say, although the arc tube in the conventional high-pressure discharge lamp for general exterior lighting has a thin and long shape, in order to realize a safety ($CeI_3$+NaI) based metal halide lamp using an alumina ceramic tube to fulfill the object of the present invention, the arc tube should have a thick and short shape basically, a relatively small range of the wall load "we", and an increased amount of NaI.

Meanwhile, in order to attain a lamp efficiency of 117 lm/W or more, which is over the conventional value by 30%, and a lamp life of 9,000 h, the molar composition rate $NaI/CeI_3$ and the arc tube shape parameter Le/ϕi need to be specified in a range of 10 or less and 0.80 or more, respectively.

As a result, it has been determined that, in order to obtain a safety ($CeI_3$+NaI) based 300 W type metal halide lamp with a high luminous efficiency and a long life using an alumina ceramic tube, the arc tube shape parameter Le/ϕi, the molar composition rate $NaI/CeI_3$ and the wall load "we" should be specified in a range of 0.80 to 1.80, 3.8 to 10, and 13 to 23 W/cm$^2$, respectively.

Figure 3:
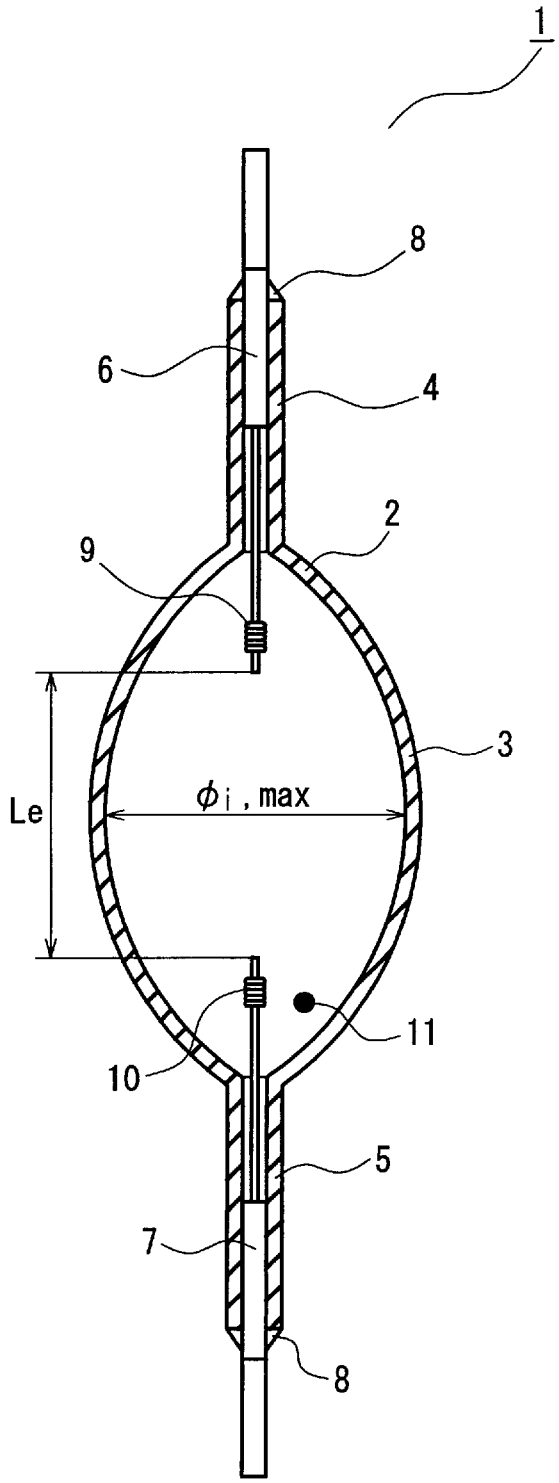
FIG. 3 is a cross-sectional view showing another construction of an arc tube in a metal halide lamp according to Embodiment 1 of the present invention.

Here, the same study was conducted as to a lamp having an elliptical shaped alumina ceramic arc tube as illustrated in FIG. 3. As a result, it was found that insofar as the wall load on the arc tube was kept within a range of 13 to 23 W/cm$^2$ in the same manner as above, a lamp having useful properties could be obtained by setting the arc tube shape parameter $Le/\phi_{i,max}$ ($\phi_{i,max}$ denotes an internal diameter of the center of the arc tube) and the molar composition rate $NaI/CeI_3$ at 0.80 to 1.80 and 3.8 to 10, respectively, like the above-described 300 W type lamp shown in FIG. 1.

Typical lamps 12 of a 300 W type, which are core products according to the invention, were prepared so as to confirm the effects for preventing the crack in the arc tube and the disappearance of the discharge arc and measure the properties such as a lamp life and a lamp efficiency. The prepared lamps had the basic configuration shown in FIGS. 1 and 2, and more specifically the distance between electrodes Le, internal diameter of the tube ϕi, arc tube shape parameter Le/ϕi, and wall load "we" were set at 23.8 mm, 17.6 mm, 1.35, and 16.8 W/cm$^2$, respectively. 12 mg of the light-emitting substance 11 with a molar composition rate $NaI/CeI_3$ of 8 and 53 mg of Hg were each filled into the tubes. As a result, with the configuration of the arc tube according to the present invention, neither the cracks in the arc tube nor the disappearance of the discharge arc were generated in these lamps, and an excellent lamp efficiency of 123 lm/W, which exceeded the target value, could be obtained. In addition, it was found that the rated lamp life could be increased to 12,500 h, exceeding the target value of 9,000 h. As for the color rendering of the lamp, the average color rendering index Ra of 60, which is the lower limit applicable to general exterior lighting purposes, could be obtained. Note here that each of these values was the average value of 10 lamps.

It should be noted that insofar as the above-stated target lamp efficiency can be satisfied, the light-emitting substance 11 may include other metal halide substances for the purpose of improving the color rendering and the life property of the lamp, in addition to the ($CeI_3$+NaI) based substance as a main component.

As a further study, the inventors of the present invention investigated the range of the arc tube shape parameter Le/ϕi (or $Le/\phi_{i,max}$) and the molar composition rate $NaI/CeI_3$, by which 200W, 400W, 700W, and 1,000 W type lamps other than the above-mentioned 300 W type lamp also can be free from the crack in the arc tube and the disappearance of the discharge arc and which can realize a high lamp efficiency up over the conventional quartz arc tube lamp by 30% and a long rated lamp life of 9,000 h or more, like the above 300 W type lamp.

Test lamps 12 for each watt lamp had the configuration shown in FIG. 2, provided with the arc tube 1 with the basic configuration shown in FIG. 1 or 3 that includes the light-emitting portion 3 and the narrow tube 4, 5 integrated with each other. In this case also, the test lamps 12 for each type were prepared having a relatively wide range of the arc tube shape parameter Le/ϕi (or Le/$\phi_{i,max}$) by changing the combination of the distance between electrodes Le and the internal diameter ϕi of the arc tube 1, in the same manner as in the above study on the 300 W type lamp. In order to attain the rated lamp life of 9,000 h or more as a target value, the wall load "we" on these lamps was specified within a range of 13 to 23 W/cm$^2$, based on the above 300 W type lamp. As for the light-emitting substance 11 as well, cerium and sodium iodide with different NaI/$CeI_3$ composition rates was filled in the lamps, like the above study on the 300 W type lamps.

With regard to these test lamps 12 for each watt type, the phenomena of cracks in the arc tube and disappearance of the discharge arc were observed during an aging operation, and properties such as the lamp efficiency and the lamp life were measured in the same manner as in the 300 W type.

Figure 4:
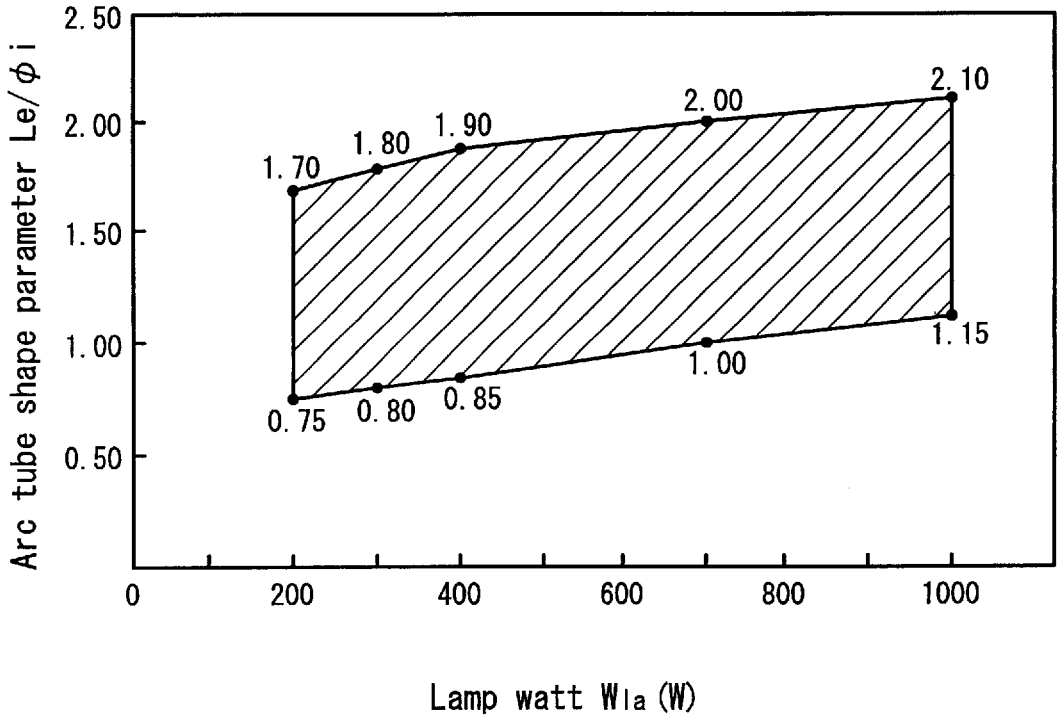
FIG. 4 shows a range of the arc tube shape parameter Le/ϕi versus the lamp wattage, specified by Embodiment 1 of the present invention.

As a result of these observations and measurements, in order to prevent the crack in the arc tube and the disappearance of the discharge arc in the test lamps 12 for each watt type, and at the same time to attain a high lamp efficiency that was over the conventional quartz arc tube lamp by 30% and a long rated lamp life of 9,000 h or more, the following has been found: (i) within the range of 13 to 23 W/cm$^2$ of the wall load "we" on the arc tube, the arc tube shape parameter Le/ϕi (or Le/$\phi_{i,max}$) should be specified within a range of 0.75 to 1.70, 0.85 to 1.90, 1.00 to 2.00 and 1.15 to 2.10 with respect to the lamp watt of 200 W, 400 W, 700 W and 1,000 W, respectively (as for the other lamp watts, see the diagonally shaded area in FIG. 4), and (ii) the molar composition rate NaI/$CeI_3$ of the light-emitting substance ($CeI_3$+NaI) should be specified within a range of 3.8 to 10. As is evident from these results, even when the lamp watt increases to 1,000 W, the arc tube shape parameter Le/ϕi described in the above (i) needs to be controlled in a range of 2.10 or less so as not to increase significantly.

Therefore, in the metal halide lamp with an alumina ceramic arc tube for general exterior lighting using a ($CeI_3$+NaI) based light-emitting substance, it can be said that the shape of the arc tube should be thick and short across the lamp watts of 200 through 1,000 W.

As described above, as for the high watt type ($CeI_3$+NaI) based metal halide lamp with an alumina ceramic arc tube for general exterior lighting, a safety metal halide lamp with a high luminous efficiency and a long life can be obtained by filling the light-emitting substance having a molar composition rate NaI/$CeI_3$ within a range of 3.8 to 10 as a main component and by setting the wall load "we" on the arc tube and the arc tube shape parameter Le/ϕi at 13 to 23 W/cm$^2$ and for example 0.80 to 1.80 in the case of the 300 W type as a core product, respectively, as shown in this embodiment.

Furthermore, since the light-emitting portion and the narrow tubes are integrated with each other, unlike the conventional metal halide lamp, there is no shrinkage fitting portion. Consequently, the lamp does not have a partially thick wall portion in the arc tube, which can reduce thermal loss from the lamp. This allows the vapor pressure of cerium to be increased, whereby the lamp efficiency further can be improved.

Note here that in the case where praseodymium is filled instead of cerium also, the same effects as above can be obtained.

In addition, although the arc tube in this embodiment is made of alumina ceramic, the arc tube may be made of, for example, YAG (Yttrium Aluminum Garnet) based ceramic or the like.

Embodiment 2

Figure 5:
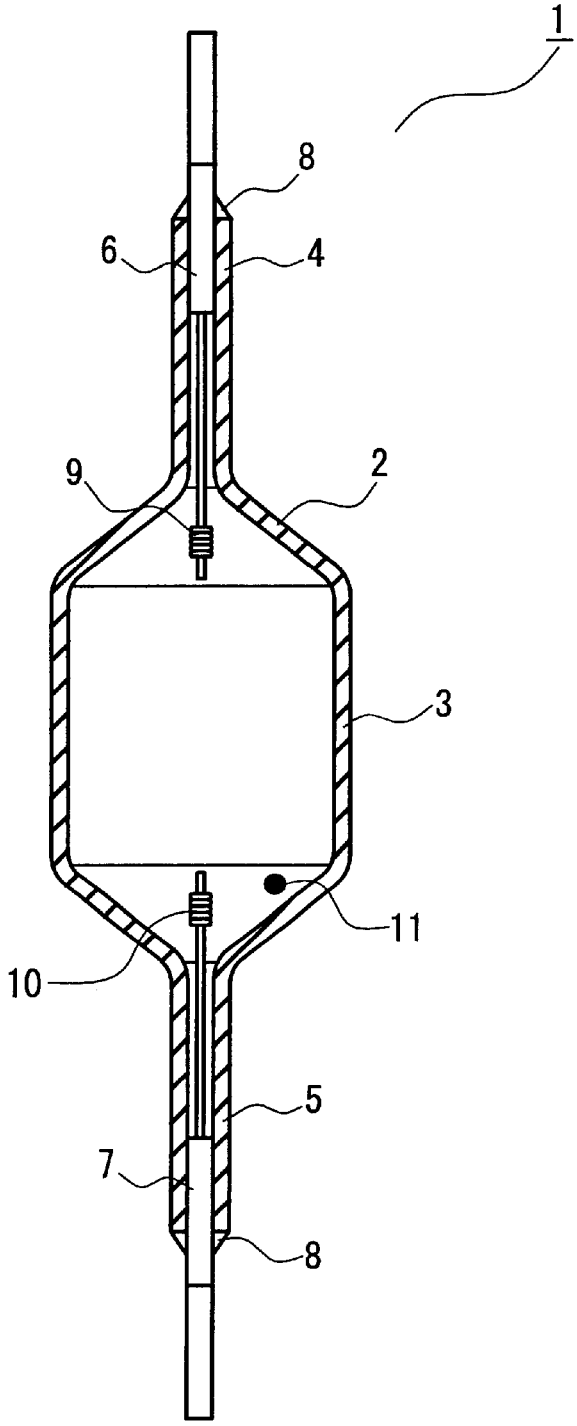
FIG. 5 is a cross-sectional view showing a construction of an arc tube in a metal halide lamp according to Embodiment 2 of the present invention.

FIG. 5 shows the construction of an arc tube 1 in a metal halide lamp according to Embodiment 2 of the present invention.

An enclosure 2 including a light-emitting portion 3 and narrow tubes 4 and 5 is made of semitransparent polycrystalline alumina ceramic. The light-emitting portion 3 has a cylindrical-shaped center portion and approximately conical and tapered end portions. At both ends of the light-emitting portion 3, the narrow tubes 4 and 5 are provided. In Embodiment 2, since the light-emitting portion 3 and the narrow tubes 4, 5 are integrated with each other, there is no shrinkage fitting portion. Therefore, unlike the conventional arc tube 115 shown in FIG. 8, there is no need of forming a partially thick wall portion in the light-emitting portion 3 (e.g., a portion around the joint between the light-emitting portion and the narrow tube). As a result, thermal loss in the arc tube 3 is small, which allows the vapor pressure of the light-emitting substance 11 to be increased sufficiently, so that the lamp efficiency can be improved.

Rod shaped electrical supply members 6 and 7 made of $Al_2O_3$—Mo based electrically conductive cermet with a resistivity of $5.1\times10^{-7}$ Ωm are sealed hermetically to the narrow tubes 4 and 5, respectively, with a ceramic frit 8 including $Dy_2O_3$—$Al_2O_3$—$SiO_2$ as its main component.

At the discharge side ends of the electrical supply members 6 and 7, electrode rods extending from tungsten electrodes 9 and 10 are connected and held, respectively. In the case of this embodiment, in order to maintain airtightness with the narrow tubes 4 and 5 securely through the lamp life, a thermal coefficient of expansion of the electrical supply members 6 and 7 is set at $6.9\times10^{-6}$/° C. for example, whereas that of the narrow tubes 4 and 5 made of alumina ceramic is $8.1\times10^{-6}$/° C. In order to suppress the erosion by the light-emitting substance 11 during operation of the lamp, the ceramic frit 8 is confined and filled so as to extend close to the joint between the narrow tube 4 or 5 and the tungsten electrode 9 or 10, which becomes a low temperature portion. A light-emitting substance 11 including cerium iodide ($CeI_3$) and sodium iodide (NaI), Hg functioning as a buffer gas and Ar of approximately 13 kPa as a rare gas for supporting ignition are each filled in the arc tube 1. The molar composition rate NaI/$CeI_3$ in the light-emitting substance 11 is 6.0.

A finished lamp 12, as shown in FIG. 2, is configured so that the arc tube 1 according to Embodiment 2 is held within an outer bulb 13 made of hard glass. In the outer bulb 13 provided with a lamp cap 14, nitrogen of 60 to 80 kPa is filled.

The following describes a result of estimating the properties of the metal halide lamp according to Embodiment 2 and the conventional metal halide lamp, on the basis of the actual measurement values.

Figure 8:
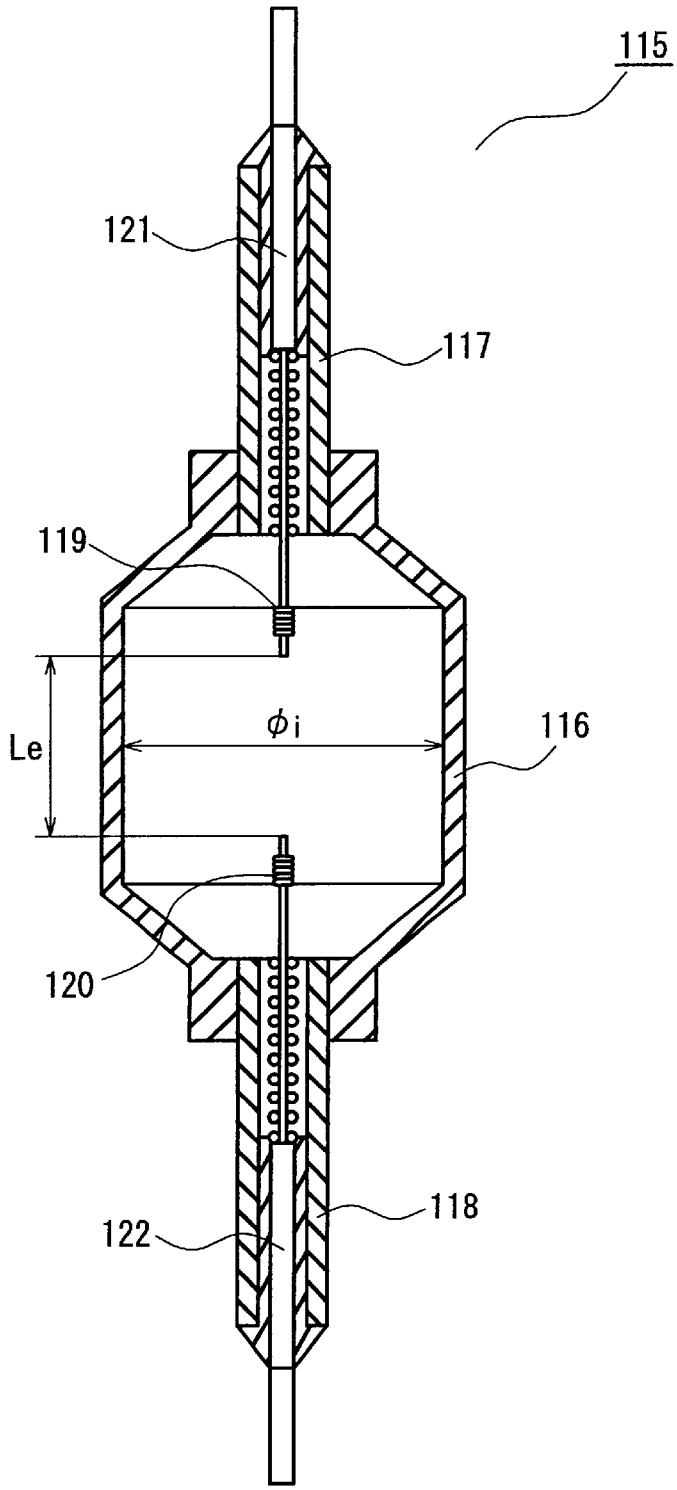
FIG. 8 PRIOR ART
FIG. 8 is a cross-sectional view showing a construction of an arc tube in a low watt type metal halide lamp with an alumina ceramic tube according to the prior art.
Figure 9:
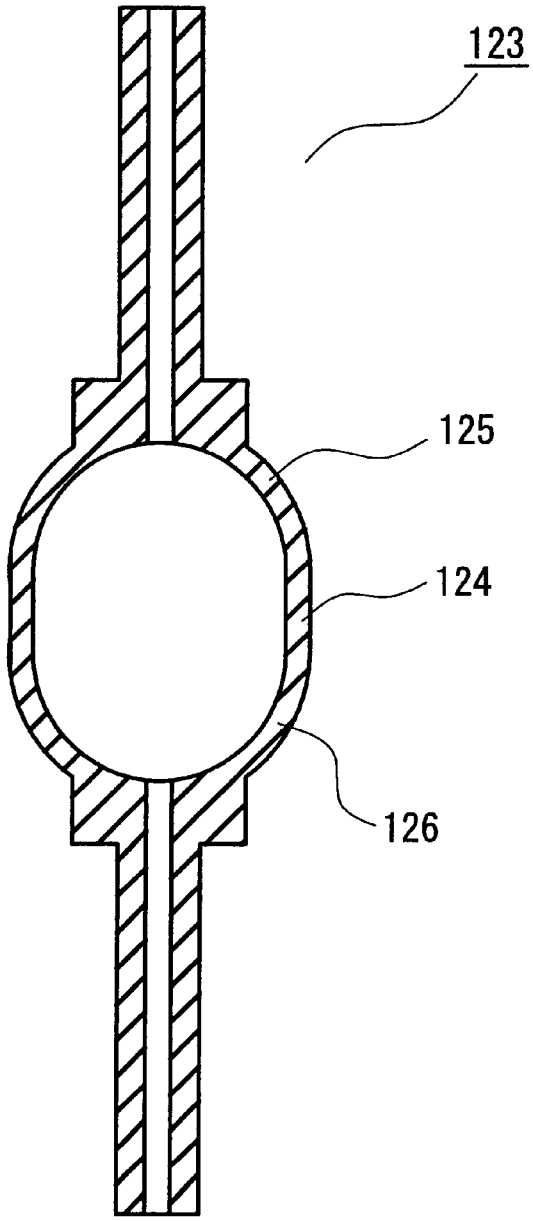
FIG. 9 PRIOR ART
FIG. 9 is a cross-sectional view showing a construction of an arc tube in a short arc type metal halide lamp with an alumina ceramic tube according to the prior art.

The basic configuration of the conventional metal halide lamp was the same as that of the lamp 12 shown in FIG. 2, but the conventional arc tube 115 formed by shrinkage fitting as shown in FIG. 8 was used as a substitute for the arc tube 1 in Embodiment 2. Into the light-emitting portions 3 and 116, cerium iodide and sodium iodide ($CeI_3$+NaI) based light-emitting substance was filled so as to constitute as 300 W type lamps. 10 samples were prepared for each metal halide lamp, and then initial efficiencies of these lamps were compared on the basis of the average of their measurement values.

As a result, while the initial efficiency of the conventional metal halide lamp was 110 lm/W, the initial efficiency of the metal halide lamp according to Embodiment 2 was 116 lm/w. Therefore, it was found that the lamp according to Embodiment 2 had a higher lamp efficiency.

As described above, according to the metal halide lamp in Embodiment 2, the enclosure 2 of the arc tube 1 is configured by integration of the light-emitting portion 3 and the narrow tubes 4 and 5. With this configuration, the lamp has an excellent airtightness, so that there is no need of forming a partially thick wall portion, which enables a small thermal loss therefrom. This allows the vapor pressure of cerium to be increased sufficiently, whereby the lamp efficiency can be improved.

In addition, although the arc tube in this embodiment is made of alumina ceramic, the arc tube may be made of, for example, YAG (Yttrium Aluminum Garnet) based ceramic or the like.

Embodiment 3

Figure 6:
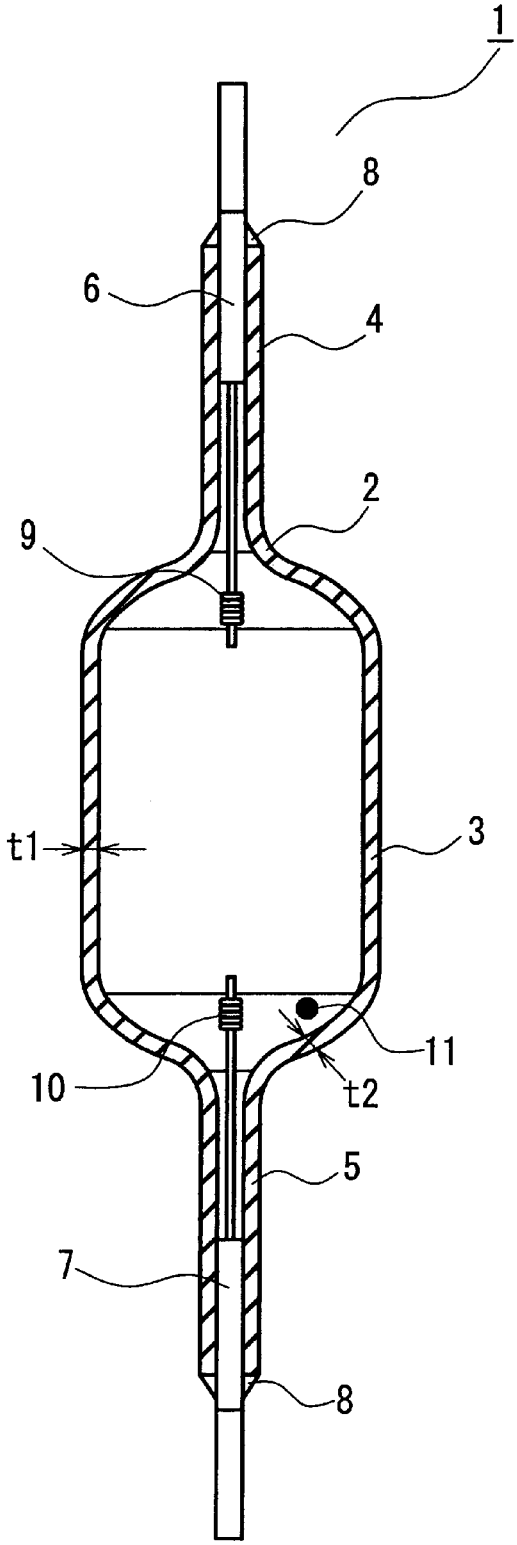
FIG. 6 is a cross-sectional view showing a construction of an arc tube in a metal halide lamp according to Embodiment 3 of the present invention.

FIG. 6 is a cross-sectional view showing the configuration of an arc tube in a metal halide lamp according to Embodiment 3 of the present invention. The basic configuration of the arc tube in Embodiment 3 is the same as that of the arc tube in Embodiment 2, but differs from Embodiment 2 in that the shape of both end portions of the light-emitting portion are not conical but approximately hemispherical.

As shown in FIG. 6, a light-emitting portion 3 and narrow tubes 4 and 5 are integrated with each other, and both end portions of the light-emitting portion 3 have an approximately hemispherical shape. With this configuration, temperatures at the inner wall of the both end portions further can be made uniform, so that for example cerium having a low vapor pressure also can evaporate securely to contribute the light-emission, resulting in improvement in the luminous efficiency.

In addition, in the case of the arc tube 1 in Embodiment 2, when the lamp is lit up in a state where a pair of tungsten electrodes 9 and 10 are arranged along the vertical direction, the liquefied light-emitting substance 11 might enter into the gap within the lower narrow tube 5, which results in a decrease in the amount of the light-emitting substance 11 in the light-emitting portion 3. As a result, the inconveniences of substantial change in the properties such as a color temperature might occur. On the contrary, the arc tube 1 in Embodiment 3 has approximately hemispherical end portions. This configuration hinders the liquefied light-emitting substance 11 from flowing along the inner wall of the both ends of the arc tube 3, but instead the light-emitting substance tends to accumulate on the inner wall. Therefore, even when the lamp is lit up in a state where a pair of tungsten electrodes 9 and 10 are arranged along the vertical direction, the tendency of liquefied light-emitting substance 11 to enter into the gap within the lower narrow tube 5 can be decreased. As a result, the amount of the light-emitting substance 11 included in the light-emitting portion 3 is not decreased, so that the degree of change in properties such as a color temperature is small.

The following describes a result of measuring the initial efficiency of the metal halide lamp according to Embodiment 3. The basic configuration of the metal halide lamp is the same as that of the lamp shown in FIG. 2, but includes the arc tube 1 shown in FIG. 6. As for other conditions on the configuration, the lamp was configured as a 300 W type metal halide lamp, which was the same as in Embodiment 2, and cerium iodide and sodium iodide ($CeI_3$+NaI) based light-emitting substance was filled therein. 10 metal halide lamps as described above were prepared, and the average of their measurement values was obtained.

As a result of the measurement, the initial efficiency of these lamps was 120 lm/w, which was higher than that in the above-described metal halide lamp according to Embodiment 2 (116 lm/W).

Also, a change in the properties concerning a color temperature during a lamp life could be suppressed. More specifically, the initial color temperature in Embodiment 2 was 4,200 K and Ra=71, which significantly changed into 4,600 K and Ra=67 after a life of 6,000 h. Whereas, in Embodiment 3, a significant change in the properties was not observed after a life of 6,000 h.

Further, the lamp efficiency and the failure probability of the arc tube during the lifetime were measured when the wall thickness t1 of the center portion of the light-emitting portion 3 and the wall thickness t2 of a portion close to the narrow tubes 4 and 5 in FIG. 6 were each changed. In the same manner as above, 10 samples were prepared for each condition, and the average value was used as the measurement value. The failure probability of the arc tube during the lifetime was measured until 6,000 h has passed. Table 1 shows a result of the measurement.

TABLE 1

| t1 (mm) | t2 (mm) | lamp efficiency (lm/W) | failure probability during the lifetime | judgment |
|---|---|---|---|---|
| 1.0 | 0.7 | 124 | 2/10 | x |
| | 0.8 | 122 | 0/10 | ○ |
| | 0.9 | 122 | 0/10 | ○ |
| | 1.0 | 120 | 0/10 | ○ |
| | 1.1 | 119 | 0/10 | ○ |
| | 1.2 | 117 | 0/10 | ○ |
| | 1.3 | 112 | 0/10 | x |
| 0.7 | 1.0 | 127 | 4/10 | x |
| 0.8 | | 126 | 0/10 | ○ |
| 0.9 | | 124 | 0/10 | ○ |
| 1.1 | | 118 | 0/10 | ○ |
| 1.2 | | 116 | 0/10 | ○ |
| 1.3 | | 111 | 0/10 | x |

As shown in Table 1, it was confirmed that when the wall thickness t2 of a portion of the light-emitting portion 3 in the vicinity of the narrow tubes 4 and 5 was varied while keeping the wall thickness t1 of the center portion of the light-emitting portion 3 constant at 1.0 mm, then the generation of a fracture was confirmed in the arc tube 1 with t2 of 0.7 mm or less during the lifetime. This is because a thin wall at a boundary portion between the light-emitting portion 3 and the narrow tubes 4, 5 is vulnerable to the reaction with the liquefied light-emitting substance 11 present around there, thus becoming brittle, which deteriorates the pressure resistance property.

When the wall thickness t2 becomes 1.3 mm or more, it was confirmed that the lamp efficiency went down significantly. This is because a thick wall at a boundary portion between the light-emitting portion 3 and the narrow tubes 4, 5 hinders the temperature of that portion from rising, which results in insufficient evaporation of the light-emitting substance 11 having a low vapor pressure and therefore a failure to contribute to the light-emission.

Next, when the wall thickness t1 of the center portion of the light-emitting portion 3 was varied while keeping the wall thickness t2 of a portion of the light-emitting portion 3 close to the narrow tubes 4 and 5 constant at 1.0 mm, then the generation of a fracture was confirmed in the arc tube 1 with t1 of 0.7 mm or less during the lifetime. A main reason of this is a deterioration in the pressure resistance property due to the thin wall of the light-emitting portion 3.

When the wall thickness t1 becomes 1.3 mm or more, it was confirmed that the lamp efficiency went down significantly. A main reason of this is a low transmittance due to the thick wall of the light-emitting portion 3.

From these results, it has been determined that thermal loss further can be lowered, a high luminous efficiency can be realized, and the generation of a fracture of the arc tube during the lifetime can be suppressed by setting a ratio of the minimum wall thickness to the maximum wall thickness of the light-emitting portion 3 at 0.80 or more.

In this embodiment, portions having the maximum and minimum wall thicknesses of the light-emitting portion 3 are located at the center portion and a portion close to the narrow tube 4, respectively. However, any portions in the light-emitting portion 3 can be selected, which produce the same effect.

In this embodiment, although the molar composition rate $NaI/CeI_3$ of the light-emitting substance 11 is set at 6.0, a range of 3.8 to 10 is preferable. Additionally, instead of NaI, dysprosium (Dy), thulium (Tm), holmium (Ho), thallium (Tl), and the like may be added as a light-emitting substance 11, depending on the required lamp properties.

Further, in the case where praseodymium is filled instead of cerium also, the same effects as above can be obtained. In that case, it is preferable that the molar composition rate $NaI/PrI_3$ is within a range of 4.5 to 12.

As described above, according to the metal halide lamp in Embodiment 3, both end portions of the light-emitting portion 3 are hemispherical. Therefore, even when the lamp is operated in a state where tungsten electrodes 9 and 10 provided in the arc tube 1 are arranged with a vertical interval between the electrodes, the liquefied light-emitting substance 11 does not intrude into the narrow tube 4 and 5, and therefore the amount of the light-emitting substance 11 is not lowered. This prevents the luminous efficiency from deteriorating.

Note here that the shape of the both end portions of the light-emitting portion 3 is not limited to hemispherical, but a curve shape in the cross-section also is acceptable, insofar as it is capable of preventing the liquefied light-emitting substance 11 from flowing into the narrow tubes 4 and 5.

Figure 7:
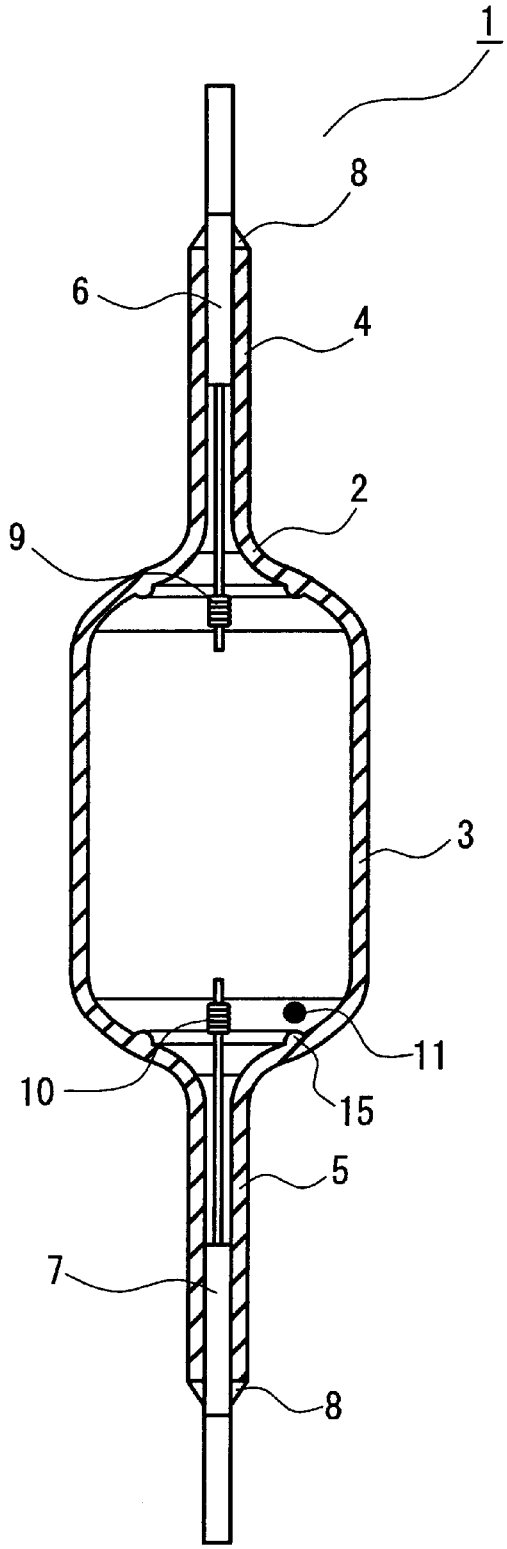
FIG. 7 is a cross-sectional view showing another construction of an arc tube in a metal halide lamp according to Embodiment 3 of the present invention.

Also, as shown in FIG. 7, protruding portions 15 may be provided so as to form a circle along the inner wall of the both end portions of the light-emitting portion 3. This configuration can prevent the liquefied light-emitting substance 11 from flowing into the narrow tubes 4 and 5. Alternatively, instead of the protruding portions 15, recesses may be provided so that the liquefied light-emitting substance 11 accumulates therein, thus preventing the substance from flowing into the narrow tubes 4 and 5.

According to the present invention, the degree of the curve of a narrowed discharge arc region, which is specific to a light-emitting substance including $CeI_3$, can be mitigated and a localized increase in temperatures of the upper side of the arc tube can be lowered. Therefore, both of the problematic phenomena of a crack in the arc tube and disappearance of the discharge arc can be prevented. In addition, green spectrum radiation having a high relative luminous efficiency from $CeI_3$ is increased, whereby a high lamp efficiency can be realized. Furthermore, temperatures of the wall of the arc tube can be kept within a range for suppressing sufficiently the reaction between the light-emitting substance and the alumina ceramic tube, and the blackening of the tube end portions can be mitigated, which can realize a long lamp life.

According to the present invention, temperatures inside of the both end portions of the light-emitting portion can be made uniform, which decreases thermal loss and prevents the light-emitting substance from being lost. As a result, the vapor pressure of the light-emitting substance can be increased adequately, and also sufficient pressure resistance properties can be realized during operation. Thereby, a metal halide lamp with a high luminous efficiency and a long lamp life can be obtained.

The present invention can suppress the generation of a fracture of the arc tube during the lifetime. Therefore, a metal halide lamp with a high luminous efficiency and a long life can be provided.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A metal halide lamp comprising an arc tube made of light-transmissive ceramic, in which a pair of electrodes is provided and cerium iodide ($CeI_3$) and sodium iodide (NaI) are enclosed as a light-emitting substance, wherein a molar composition rate $NaI/CeI_3$ of the light-emitting substance is specified within a range of 3.8 to 10, inclusive, and a wall load on the arc tube ranges from 13 to 23 $W/cm^2$, inclusive, and on a series of X, Y coordinates, where X denotes a value of a lamp wattage (W) and Y denotes a value of $Le/\phi i$, where Le and $\phi i$ denote a distance between the pair of electrodes and an internal diameter of the arc tube, respectively, values of the $Le/\phi i$ and the lamp wattage are specified to be within a range surrounded by lines passing through the points (200, 0.75), (300,0.80), (400, 0.85), (700, 1.00), (1,000, 1.15), (1,000, 2.10), (700, 2.00), (400, 1.90), (300, 1.80), and (200, 1.70) in this stated order.

2. A metal halide lamp comprising an arc tube made of light-transmissive ceramic, the arc tube comprising: a light-emitting portion in which a pair of electrodes is provided and a light-emitting substance including at least one of cerium (Ce) and praseodymium (Pr) is enclosed; narrow tubes provided at both end portions of the light-emitting portion; and an electrical supply member that is sealed within one of the narrow tube and connected to one of the pair of electrodes, wherein the light-emitting portion is configured so that a ratio of a minimum wall thickness to a maximum wall thickness thereof becomes 0.80 or more, and the light-emitting portion and each of the narrow tubes are integrated with each other.

3. The metal halide lamp according to claim 2, wherein the both end portions of the light-emitting portion have a shape whose diameter becomes smaller gradually with increasing proximity to the narrow tube.

4. The metal halide lamp according to claim 3, wherein the both end portions of the light-emitting portion have a tapered shape.

5. The metal halide lamp according to claim 3, wherein a cross-sectional shape of the both end portions of the light-emitting portion is formed in a curve.

6. The metal halide lamp according to claim 5, wherein the both end portions of the light-emitting portion have an approximately hemispherical shape.

7. The metal halide lamp according to claim 3, wherein on an inner wall of the both end portions of the light-emitting portion, protrusions or recesses are formed.

* * * * *